US006093086A

United States Patent [19]

Easter et al.

[11] Patent Number: 6,093,086

[45] Date of Patent: Jul. 25, 2000

[54] POLISHING HEAD RELEASE MECHANISM

[75] Inventors: William G. Easter; John A. Maze; Frank Miceli; Jose O. Rodriguez, all of Orlando, Fla.

[73] Assignee: Lucent Technologies Inc., Murray Hill, N.J.

[21] Appl. No.: 09/405,617

[22] Filed: Sep. 24, 1999

[51] Int. Cl.[7] ..... B24B 1/00

[52] U.S. Cl. ..... 451/41; 251/67; 251/288; 251/290

[58] Field of Search ..... 451/41, 279, 285, 451/365, 67, 288, 290; 216/88, 89; 29/401.1, 402.03, 402.15, 426.4, 525.01, 525.02

[56] References Cited

U.S. PATENT DOCUMENTS 5,588,902 12/1996 Tominaga et al. .
5,720,653 2/1998 Miller et al. .
5,893,755 4/1999 Nakayoshi .
6,019,670 2/2000 Cheng et al. .
6,019,868 2/2000 Kimura et al. .

*Primary Examiner*—Timothy V. Eley
*Assistant Examiner*—Willie Berry, Jr.

[57] ABSTRACT

The present invention provides a method of manufacturing an integrated circuit using a polishing head release mechanism. The polishing head release mechanism is for use with a polishing tool having a polishing head and a polishing platen. In one embodiment, the polishing head release mechanism comprises a platen protective shield, shield-to-platen retainers, and retaining clamps. The shield-to-platen retainers are configured to removably couple the platen protective shield to the polishing platen. The retaining clamps are couplable to the platen protective shield and configured to couple the polishing head to the platen protective shield.

23 Claims, 3 Drawing Sheets

POLISHING HEAD RELEASE MECHANISM

TECHNICAL FIELD OF THE INVENTION

The present invention is directed, in general, to a semiconductor wafer polishing apparatus and, more specifically, to a device to assist an operator in removing a polishing head that resists removal from a polishing apparatus mounting flange.

BACKGROUND OF THE INVENTION

Chemical/mechanical planarization (CMP) is an essential process in the manufacture of semiconductor chips today. During CMP, the combination of chemical etching and mechanical abrasion produces the required flat, precise surface for subsequent depositions. In the CMP process, the semiconductor wafer is retained in a circular carrier head and pressed against a polyurethane polishing pad covered with a chemical slurry. The pressure exerted on the wafer, the rates of rotation of the platen and the carrier head, the chemical composition of the slurry, the temperature of the environment, and the condition of the polishing pad are all closely controlled. The object is to have a repeatable, consistent process each time so that each wafer is as close as possible to an exact copy of every other wafer.

Therefore, every effort is made in semiconductor manufacture to tightly control all factors of the process in order to insure uniformity of the product. Preventive maintenance is therefore a key element. However, one problem has arisen that has not been addressed to date. That is, the carrier heads must be removed from time to time from the mounting flange for preventive maintenance or repair. The carrier head is typically secured to the mounting flange by three pins that extend from the carrier head and mate with cooperating openings in the mounting flange. Over time, because of the close fit between the pins and the openings, the pins or the openings may become slightly damaged. As a result, an interference fit occurs when the carrier head is subsequently installed to the mounting flange. This can cause the carrier head to later resist removal. Of course, other problems such as corrosion, etc., may also make it difficult to remove the carrier head from the mounting flange. Due to the difficulty in removing the carrier head from the mounting flange, the carrier head or other parts of the polishing apparatus can be damaged, which can not only lead to increased manufacturing costs, but it can lead to extended downtime periods as well.

Accordingly, what is needed in the art is a device and method to assist in removing the carrier head from the mounting flange when the carrier head resists normal removal techniques.

SUMMARY OF THE INVENTION

To address the above-discussed deficiencies of the prior art, the present invention provides a method of manufacturing an integrated circuit using a polishing head release mechanism. The polishing head release mechanism is for use with a polishing tool having a polishing head and a polishing platen. In one embodiment, the polishing head release mechanism comprises a platen protective shield, shield-to-platen retainers, and retaining clamps. The shield-to-platen retainers are configured to removably couple the platen protective shield to the polishing platen. The retaining clamps are couplable to the platen protective shield and configured to couple the polishing head to the platen protective shield.

Thus, in a broad sense, the present invention provides a device and method for assisting an operator in separating a mounting flange from a polishing head that resists normal removal techniques. The weight of the polishing platen and structure are used to secure the polishing head while a separating force is applied to the mounting flange.

In another embodiment, the retaining clamps are rotatable retaining clamps coupled to the platen protective shield and rotatable with respect to the platen protective shield. In another related embodiment, the retaining clamps are slidable retaining clamps couplable to the platen protective shield. In a further aspect, the platen protective shield comprises keyhole slots, each of the keyhole slots configured to receive a portion of one of the slidable retaining clamps. The polishing head release mechanism may further comprise clamp locks coupled to the retaining clamps and configured to secure the retaining clamps in contact with the carrier head.

The polishing head release mechanism, in a particularly advantageous embodiment, further comprises an overload release coupled to each of the retaining clamps and to the platen protective shield. The overload release is configured to decouple the retaining clamps from the platen protective shield when a separation force exceeds a nominal value. In one aspect, the overload release may be a crush cylinder configured to buckle when the separation force exceeds the nominal value. Alternatively, the overload release may be a pivot hinge configured to shear when the separation force exceeds the nominal value.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
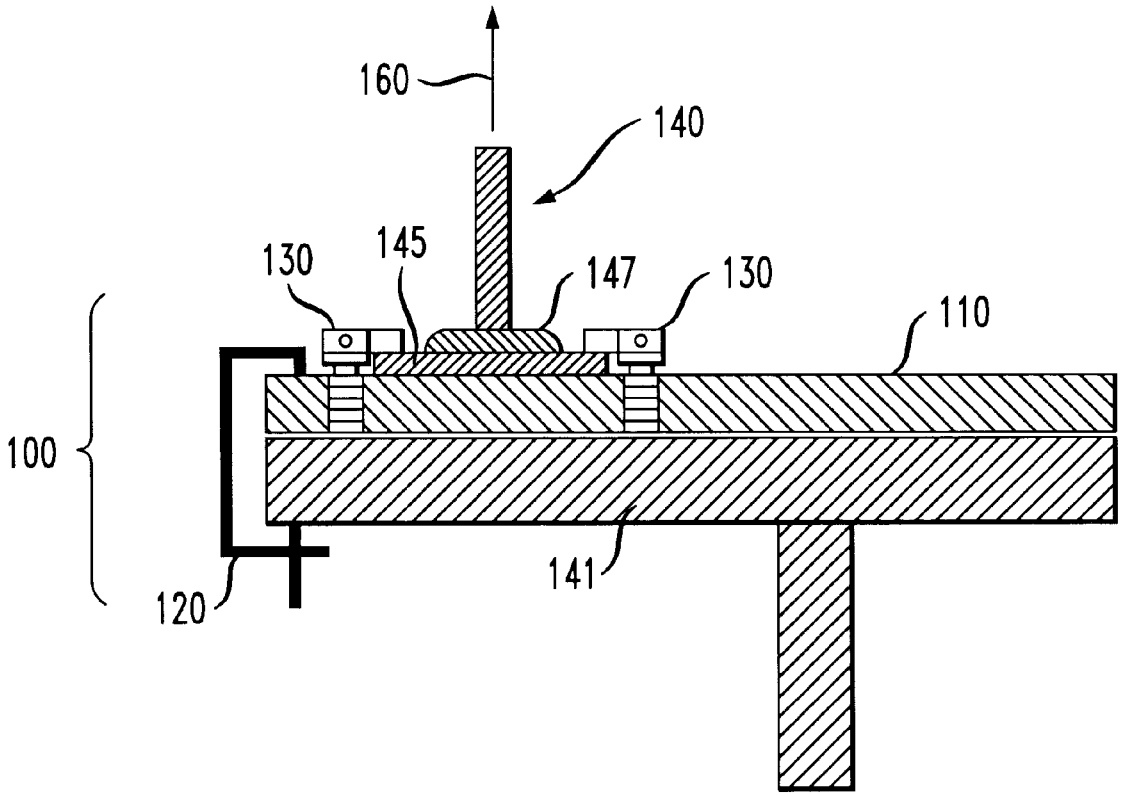
FIG. 1 illustrates an elevational view of one embodiment of a polishing head release mechanism constructed according to the principles of the present invention.

Referring initially to FIG. 1, illustrated is a partial elevational view of one embodiment of a polishing head release mechanism constructed according to the principles of the present invention. A polishing head release mechanism 100 comprises a platen protective shield 110, shield-to-platen retainers 120 (one shown), and retaining clamps 130. The platen protective shield 110 may be a disc configured to lay atop a polishing platen 141 of a polishing apparatus 140 having a polishing head 145 temporarily stuck to a mounting flange 147. The platen protective shield 110 is secured to the polishing platen 141 with the shield-to-platen retainers 120. In the illustrated embodiment, the shield-to-platen retainers 121 are C-clamps, however, one who is skilled in the art will readily envision other devices to secure the platen protective shield 110 to the polishing platen 141, such as spring clamps, corresponding and cooperating latches on the planten and shield.

The retaining clamps 130 are coupled to the platen protective shield 110 by methods to be discussed below with reference to FIGS. 2A and 2B. The retaining clamps 130 removably couple the polishing head 145 to the protective shield 110, and therefore to the polishing platen 141, in turn, with the cooperation of the shield-to-platen retainers 120. Once the platen protective shield 110, shield-to-platen retainers 120, and retaining clamps 130 are in place, an extraction force 160 may be applied to the mounting flange 147. The mass of the polishing platen 141 and other parts (not shown) of the polishing apparatus 140 therefore will resist motion of the polishing head 145, enabling the polishing head 145 to be separated from the mounting flange 147.

Figure 2A:
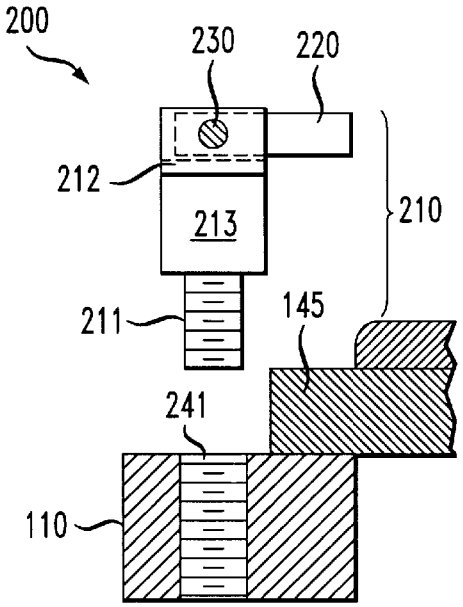
FIGS. 2A and 2B illustrate exploded isometric views of two embodiments of the retaining clamps of FIG. 1.
Figure 2B:
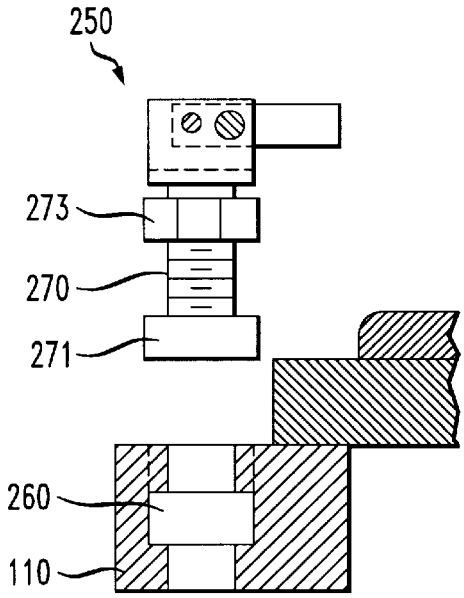

Referring now to FIGS. 2A and 2B, illustrated are exploded elevational views of two different embodiments of the retaining clamps of FIG. 1. In FIG. 2A, a retaining clamp 200 comprises a clamp body 210, a clamp arm 220, and a pivot pin 230. The clamp body 210 may comprise an externally threaded shaft 211 that couples to internally threaded apertures 241 of the platen protective shield 110. In this embodiment, the clamp body 210 may be two pieces 212, 213 so that the retaining clamp 200 may be permanently affixed to the platen protective shield 110 and the clamp arm 220 rotated horizontally into location to couple the polishing head 145 to the platen protective shield 110. In another embodiment as illustrated in FIG. 2B, a retaining clamp 250 may be removably coupled to the platen protective shield 110 by configuring the shield 110 with keyhole slots 260 that accept a head 271 of a cap screw 270. Therefore, in this embodiment the retaining clamp 250 slidably engages the platen protective shield 110. A locking nut 273 may be used to secure the retaining clamp 250 to the platen protective shield 110. Of course, these two embodiments of retaining clamps 200, 250 are only representative and other methods of coupling the retaining clamps 130 of FIG. 1 to the platen protective shield 110 may devised by one who is skilled in the art. Such other embodiments are considered to be within the greater scope of the present invention.

Figure 3A:
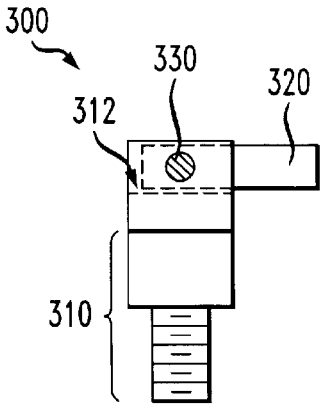
FIGS. 3A and 3B illustrate isometric views of two embodiments of the retaining clamps of FIG. 1.
Figure 3B:
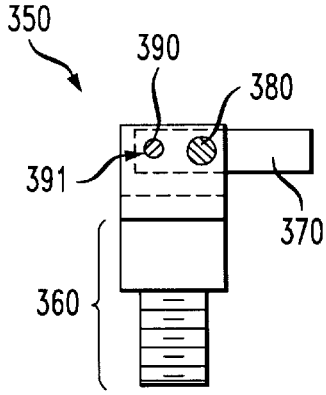

Referring now to FIGS. 3A and 3B with continuing reference to FIG. 1, illustrated are isometric views of two embodiments of the heads of retaining clamps 130 of FIG. 1. In FIG. 3A, a retaining clamp 300 comprises a clamp body 310, a clamp arm 320, and a pivot pin 330. This retaining clamp 300 may be permanently or temporarily fastened to the platen protective shield 110 of FIG. 1 as previously described. This retaining clamp 300 is locked into place by rotating the clamp arm 320 horizontally over the polishing head 145. The pivot pin 330 acts as a fulcrum about which the clamp arm 320 may minimally rotate when the separation force 160 is applied to the mounting flange 147. Actual rotation is restricted by surface 312, that may be considered a clamp lock, so that if the separation force 160 applied exceeds a nominal value, the pivot pin 330 shears. The shearing action releases the polishing head 145 and prevents damage to the polishing head 145, platen protective shield 110 or other parts of the system. In one advantageous embodiment, the nominal value may exceed the weight of the polishing head by as little as one pound force. However, in alternative embodiments, the nominal value may exceed the weight of the polishing head by a percentage of the weight of the polishing head. Of course, the nominal value should never be increased to a point where violent separation of the polishing head and mounting flange may occur. One who is skilled in the art will readily size the nominal value based upon the size of the mounting pins.

Referring now to FIG. 3B with continuing reference to FIG. 1, a retaining clamp 350 comprises a clamp body 360, a clamp arm 370, a hinge pin 380, and a shear pin 390. This retaining clamp 350 may be installed in the platen protective shield 110 by any of the above described methods. The retaining clamp 350 may be locked into place by rotating the clamp arm 370 vertically about hinge pin 380 and over the polishing head 145, whereupon shear pin 390 is inserted into apertures 391. The hinge pin 380 acts as a fulcrum about which the clamp arm 370 may minimally rotate when force 160 is applied to the mounting flange 147. Actual rotation is restricted by shear pin 390 until the force 160 applied exceeds the nominal value and the shear pin 390 shears, releasing the mounting flange 147 from the polishing head 145 and preventing damage to the polishing head 145, platen protective shield 110 or other parts of the system. In this embodiment, shear pin 390 may also be considered a clamp lock. While two retaining clamps 300, 350 have been specifically described, one who is skilled in the art will readily understand that other methods may also be engineered to couple the polishing head 145 to the platen protective shield 110.

Figure 4:
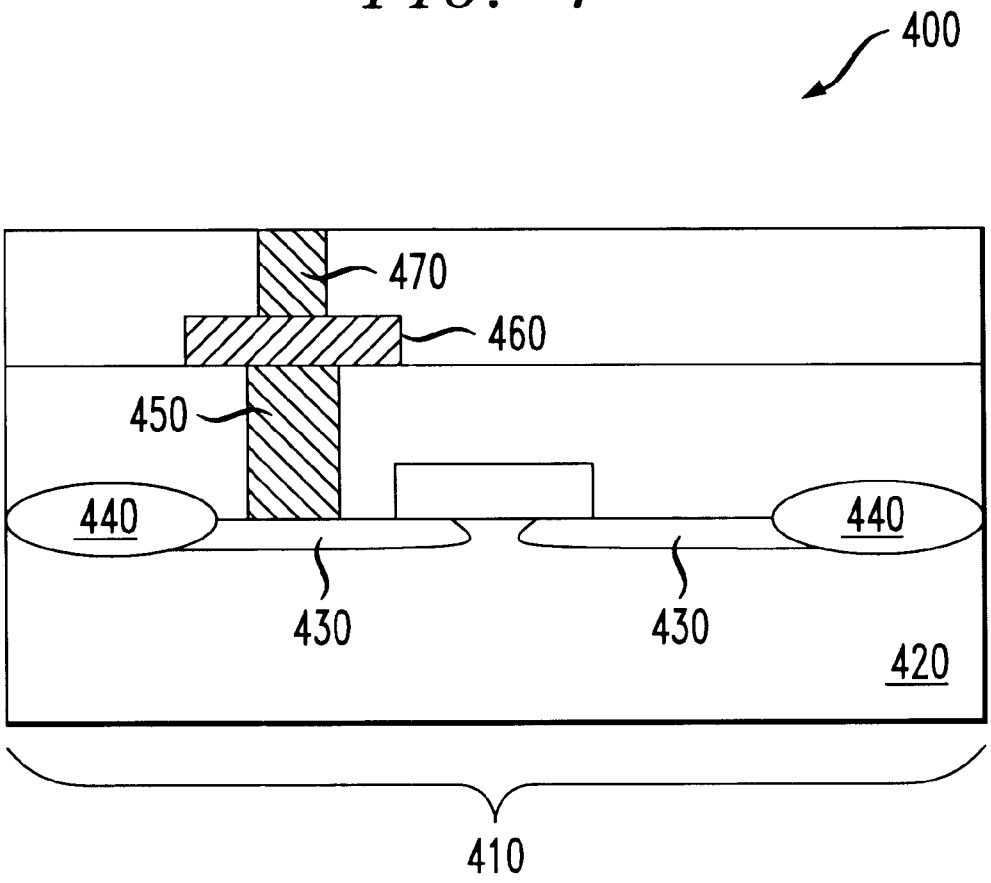
FIG. 4 illustrates a partial sectional view of a conventional integrated circuit that can be manufactured using a semiconductor wafer polishing head transport apparatus constructed in accordance with the principles of the present invention.

Referring now to FIG. 4, illustrated is a partial sectional view of a conventional integrated circuit 400 that can be manufactured using the polishing head release mechanism constructed in accordance with the principles of the present invention. In this particular sectional view, there is illustrated an active device 410 that comprises a tub region 420, source/drain regions 430 and field oxides 440, which together may form a conventional transistor, such as a CMOS, PMOS, NMOS or bi-polar transistor. A contact plug 450 contacts the active device 410. The contact plug 450 is, in turn, contacted by a trace 460 that connects to other regions of the integrated circuit, which are not shown. A VIA 470 contacts the trace 460, which provides electrical connection to subsequent levels of the integrated circuit. One who is skilled in the art is familiar with the need to planarize the integrated circuit 400 several times during manufacture. Such planarization may necessitate removal and maintenance of the polishing head with the described invention.

Thus, a polishing head release mechanism has been described that incorporates a platen protective shield, shield-to-platen retainers, and retaining clamps. The combined assembly assists a technician in using the weight of the polishing apparatus to separate a polishing head that has become stuck to a mounting flange.

Although the present invention has been described in detail, those skilled in the art should understand that they can make various changes, substitutions and alterations herein without departing from the spirit and scope of the invention in its broadest form.

What is claimed is:

1. For use with a polishing tool having a polishing head and a polishing platen, a polishing head release mechanism, comprising:

a platen protective shield;

shield-to-platen retainers configured to removably couple the platen protective shield to the polishing platen; and retaining clamps couplable to the platen protective shield and configured to couple the polishing head to the platen protective shield.

2. The polishing head release mechanism as recited in claim 1 wherein the retaining clamps are rotatable retaining clamps coupled to the platen protective shield and rotatable with respect to the platen protective shield.

3. The polishing head release mechanism as recited in claim 1 wherein the retaining clamps are slidable retaining clamps couplable to the platen protective shield.

4. The polishing head release mechanism as recited in claim 3 wherein the platen protective shield comprises keyhole slots, each of the keyhole slots configured to receive a portion of one of the slidable retaining clamps.

5. The polishing head release mechanism as recited in claim 1 further comprising clamp locks coupled to the retaining clamps and configured to secure the retaining clamps in contact with the carrier head.

6. The polishing head release mechanism as recited in claim 1 further comprising an overload release coupled to each of the retaining clamps, the overload release configured to decouple the retaining clamps from the polishing head when a separation force exceeds a nominal value.

7. The polishing head release mechanism as recited in claim 6 wherein the overload release is a shear pin configured to shear when the separation force exceeds the nominal value.

8. The polishing head release mechanism as recited in claim 6 wherein the overload release is a pivot pin configured to shear when the separation force exceeds the nominal value.

9. A method of manufacturing a polishing head release mechanism, comprising:

providing a platen protective shield;

coupling shield-to-platen retainers to the platen protective shield, the shield-to-platen retainers configured to removably couple the platen protective shield to the polishing platen; and coupling retaining clamps to the platen protective shield, the retaining clamps configured to couple a polishing head to the platen protective shield.

10. The method as recited in claim 9 wherein coupling retaining clamps includes coupling rotatable retaining clamps rotatable with respect to the platen protective shield.

11. The method as recited in claim 9 wherein coupling retaining clamps includes coupling slidable retaining clamps slidably couplable to the platen protective shield.

12. The method as recited in claim 9 further comprising coupling clamp locks to the retaining clamps, the clamp locks configured to secure the retaining clamps in contact with the carrier head.

13. The method as recited in claim 9 further comprising an coupling an overload release to each of the retaining clamps and to the platen protective shield, the overload release configured to decouple the retaining clamps from the platen protective shield when a separation force exceeds a nominal value.

14. The method as recited in claim 13 wherein coupling an overload release includes coupling a shear pin or a pivot pin, the shear pin or the pivot pin configured to shear when the separation force exceeds the nominal value.

15. A method of manufacturing an integrated circuit, comprising:

polishing a substrate of a semiconductor wafer with a polishing tool having a polishing head and a polishing platen;

coupling a platen protective shield to the polishing platen with shield-to-platen retainers;

coupling the polishing head to the platen protective shield with retaining clamps; and pulling on a mounting flange coupled to the polishing head with a load cell, the retaining clamps and the shield-to-platen retainers cooperating to resist a motion of the polishing head.

16. The method as recited in claim 15 wherein coupling the polishing head includes coupling the polishing head with rotatable retaining clamps coupled to the platen protective shield and rotatable with respect to the platen protective shield.

17. The method as recited in claim 15 wherein coupling the polishing head includes coupling the polishing head with slidable retaining clamps couplable to the platen protective shield.

18. The method as recited in claim 15 further comprising coupling an overload release to each of the retaining clamps and to the platen protective shield, the overload release decoupling the retaining clamps from the polishing head when a separation force exceeds a nominal value.

19. The method as recited in claim 18 wherein the decoupling is shearing of a shear pin or a pivot pin when the separation force exceeds the nominal value.

20. An integrated circuit as made by the method recited in claim 15.

21. The integrated circuit as recited in claim 20 wherein the integrated circuit includes a transistor selected from the group consisting of:

a CMOS transistor, an NMOS transistor, a PMOS transistor, and a bipolar transistor.

22. The integrated circuit as recited in claim 20 further comprising forming electrical interconnects within the integrated circuit.

23. The integrated circuit as recited in claim 22 wherein forming electrical interconnects includes forming an electrical interconnect selected from the group consisting of:

a contact plug, a VIA, and a trace.

* * * * *